US007541130B2

(12) United States Patent
Guistina et al.

(10) Patent No.: US 7,541,130 B2
(45) Date of Patent: Jun. 2, 2009

(54) SULFONE CHARGE CONTROL AGENTS FOR ELECTROSTATOGRAPHIC TONERS

(75) Inventors: Robert A. Guistina, Rochester, NY (US); Dinesh Tyagi, Fairport, NY (US); Jason Morgan, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 429 days.

(21) Appl. No.: 11/264,735

(22) Filed: Nov. 1, 2005

(65) Prior Publication Data

US 2007/0099103 A1 May 3, 2007

(51) Int. Cl.
*G03G 9/08* (2006.01)

(52) U.S. Cl. ..... 430/108.5; 430/109.1; 430/109.5

(58) Field of Classification Search ..... 430/108.5, 430/109.1, 109.5
See application file for complete search history.

(56) References Cited

U.S. PATENT DOCUMENTS

| | | | | |
|---|---|---|---|---|
| 3,547,822 | A | | 12/1970 | Miller |
| 3,632,512 | A | | 1/1972 | Miller |
| 3,795,618 | A | | 3/1974 | Kasper |
| 3,898,170 | A | | 8/1975 | Kasper |
| 3,970,571 | A | | 7/1976 | Olson et al. |
| 4,042,518 | A | | 8/1977 | Jones |
| 4,076,857 | A | | 2/1978 | Kasper et al. |
| 4,394,430 | A | | 7/1983 | Jadwin et al. |
| 4,478,925 | A | | 10/1984 | Miskinis |
| 4,480,021 | A | | 10/1984 | Lu et al. |
| 4,546,060 | A | | 10/1985 | Miskinis et al. |
| 4,684,596 | A | | 8/1987 | Bonser et al. |
| 5,378,571 | A | * | 1/1995 | Macholdt et al. ..... 430/108.2 |
| 5,382,490 | A | * | 1/1995 | Yamamura et al. ..... 430/110.2 |
| 5,545,060 | A | | 8/1996 | Gow |
| 6,039,793 | A | * | 3/2000 | Gundlach et al. ..... 106/31.28 |
| 6,057,072 | A | * | 5/2000 | Guistina et al. ..... 430/109.3 |

FOREIGN PATENT DOCUMENTS

| | | |
|---|---|---|
| BE | 797132 | 9/1973 |

* cited by examiner

*Primary Examiner*—John L Goodrow
(74) *Attorney, Agent, or Firm*—Carl F. Ruoff; Andrew J. Anderson

(57) ABSTRACT

The present invention is directed to an electrostatographic toner having a sulfone charge control agent having the structure X—$SO_2$—Y wherein X is an alkyl or aromatic group and Y is an alkyl or aromatic group. The present invention is also directed to an electorstatographic developer containing the electrostatographic toner having a sulfone charge control agent having the structure X—$SO_2$—Y wherein X is an alkyl or aromatic group and Y is an alkyl or aromatic group and carrier particles.

16 Claims, No Drawings

SULFONE CHARGE CONTROL AGENTS FOR ELECTROSTATOGRAPHIC TONERS

FIELD OF THE INVENTION

This invention relates to certain new electrostatographic toners and developers containing at least a polymeric binder, and a colorless negative charge control agent. The toners and developers thus obtained have stable triboelectric properties. More particularly, the inventive toners and developers yield stable negative polarity having good charging properties without unacceptable interactions with other developer or system components. The inventive charge control agents do not add color to the toner binders rendering them exceptionally useful for color toner applications.

BACKGROUND OF THE INVENTION

In electrostatography an image composed of an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface. If the particles do not charge quickly enough, lose their charge, or do not charge to a high enough value then they may fly off the carrier particles in an uncontrolled fashion causing high levels of toner dust in the apparatus. High levels of toner dust can cause severe damage to the electrophotographic apparatus, resulting in contaminated gears, mirrors, lenses etc.

The toner particles in dry developers often contain material referred to as a charge agent or charge-control agent, which helps to establish and maintain toner charge within an acceptable range. Many types of charge-control agents have been used and are described in the published patent literature. Charge control agents may charge toner particle positively or negatively. Charge control agents yielding toner particles with stable positive charge are more ubiquitous than those yielding toners with stable negative charge. In fact few additives are known which yield toners with stable negative charge. Some of the known negative charge control agents are highly colored rendering them unacceptable for use in anything but black toners. All of the negative charge agents tend to be complex molecules and as such are expensive and add significant expense to the final toner product.

Additionally, some of the known charge agents will adversely interact chemically and/or physically with other developer or copier components. For example, some will interact with carrier or carrier coating materials (e.g., fluorohydrocarbon polymer coatings such as poly(vinylidene fluoride)) and lead to premature carrier aging and shortened useful developer life. Some will chemically interact with certain toner colorants to cause unacceptable hue shifts in the toner. Some being highly colored will be objectionable for use in typical color toners since such a property will also cause objectionable hue shifts. Some will interact with copier fuser rollers (e.g., rollers coated with fluorohydrocarbon polymers such as poly(vinylidene fluoride-co-hexafluoropropylene)) to cause premature failure of the copier's toner fusing system.

It would, therefore, be desirable to provide new dry negative polarity electrographic toners and developers containing charge control agents that perform the charge-controlling function well, while avoiding or minimizing all of the drawbacks noted above. The present invention does this.

SUMMARY OF THE INVENTION

The present invention is directed to overcoming one or more of the problems set forth above. The invention is generally accomplished by providing an electrostatographic toner comprising a sulfone charge control agent having the structure:

$X—SO_2—Y$ wherein X is an alkyl or aromatic group and Y is an alkyl or aromatic group.

The present invention is also directed to an electorstatographic developer containing the electrostatographic toner having a sulfone charge control agent having the structure $X—SO_2—Y$ wherein X is an alkyl or aromatic group and Y is an alkyl or aromatic group and carrier particles.

DETAILED DESCRIPTION OF THE INVENTION

The invention provides new dry, particulate, negative polarity electrostatographic toners and developers containing new charge-control agents comprising chemical compounds containing the sulfone ($—SO_2—$) functionality. The sulfone charge control agent has the structure:

$$X—SO_2—Y$$

wherein X is an alkyl or aromatic group and Y is an alkyl or aromatic group.

In a preferred form of the invention the sulfones may be dialkyl (I)

$$R—SO_2—R'$$

where R and R' are alkyl groups containing from 1 to 24 carbon atoms. R may or may not be the same as R'. R and R' may contain a variety of functional groups such as carboxylate, sulfonate, ester, alcohol, amine. The position of the functional group on the chain is not critical to efficacy in the application. R and R' groups may also be saturated cyclic moieties which may or may not contain heteroatoms such as sulfur, oxygen, phosphorous and nitrogen.

Of this type of sulfone compound dimethylsulfone is particularly preferred.

The sulfones may be diaromatic (II)

$$Ar—SO_2—Ar' \qquad II$$

Where Ar and Ar' are phenyl rings ($C_6H_5$). Ar and Ar' may or may not be the same. The aromatic rings can be substituted with a wide variety of functional groups including alkyl groups with alkyl chains from 1 to 24 carbon atoms, nitro groups, halogen atoms, carboxyl and sulfonate groups including esters thereof. The preceding listing is not exhaustive and does not limit the scope of this invention. Ar and Ar' groups may also be moieties which may or may not contain hetero atoms such as sulfur, oxygen, phosphorous and nitrogen. Of this type of sulfone compound diphenylsulfone is found to be particularly preferred.

The sulfones may be mixed aromatic/aliphatic (III)

$$Ar—SO_2—R \qquad III$$

Where Ar and R may have any of the structures discussed in formulas I and II above.

The inventive toners comprise a polymeric binder, a colorant and the inventive sulfone charge control agent that functions as an effective negative charge-control agent. The inventive developers comprise carrier particles and the inventive particulate toner as defined above.

The sulfone charge control agents provide good charge-control in the inventive toners and developers. The inventive toners and developers do not exhibit unacceptably high conductivity or environmental sensitivity. The inventive toners and developers have not been found to interact unacceptably with commonly utilized toner colorants, carrier materials, or copier components such as fuser rolls. Additionally, being colorless or very low in color the inventive materials are found to be particularly suited for application in colored toners.

It should be noted that the use of organic compounds containing the sulfone functionality of this invention have not been described previously in the patent literature for use as negative polarity charge control agents as applied to electrostatographic toners.

The new charge agents employed in the toners and developers of the invention can be purchased from commercial suppliers such as Aldrich Chemical Co. Although any of the various sulfone structures discussed above are useful inventive charge agents the compounds dimethylsulfone and diphenylsulfone are particularly preferred. These compounds are readily available from commercial sources in large quantities. To be utilized as a charge-control agent in the electrostatographic toners of the invention, the sulfone compound is mixed in any convenient manner (preferably by extrusion as described, for example, in U.S. Pat. Nos. 4,684,596 and 4,394,430) with an appropriate polymeric toner binder material and any other desired addenda, and the mix is then ground to desired size to form a free-flowing powder of toner particles containing the charge agent. The final toner but is preferably surface treated with a low surface energy component such as derivatized silica, titania, zirconia or other metal oxide such as zinc oxide.

Toner particles of the invention have an average diameter between about 0.1 μm and about 100 μm, a value in the range from about 1.0 to about 15 μm being preferable for many currently used machines. However, larger or smaller particles may be needed for particular methods of development or development conditions.

Generally, it has been found desirable to add from about 0.1 to about 6 parts and preferably 0.3 to about 3.0 parts by weight of the aforementioned sulfone compound per 100 parts by weight of the binder polymer to obtain the improved toner composition of the present invention. Although larger or smaller amounts of a charge control agent can be added, it has been found that if amounts much lower than those specified above are utilized, the charge-control agent tends to exhibit little or substantially no improvement in the properties of the toner composition. As amounts more than about 6 parts of charge-control agent per 100 parts of polymeric binder are added, it has been found that the net toner charge exhibited by the resultant toner composition tends to be reduced. Of course, it must be recognized that the optimum amount of charge-control agent to be added will depend, in part, on the particular sulfone compound selected and the particular polymer with which it is compounded. However, the amounts specified herein above are typical of the useful range of charge-control agent utilized in conventional dry toner materials.

The polymers useful as toner binders in the practice of the present invention can be used alone or in combination and include those polymers conventionally employed in electrostatic toners. Useful polymers generally have a glass transition temperature within the range of from 50 to 120° C. Preferably, toner particles prepared from these polymers have relatively high caking temperature, for example, higher than about 60° C., so that the toner powders can be stored for relatively long periods of time at fairly high temperatures without having individual particles agglomerate and clump together. The melting point of useful polymers preferably is within the range of from about 65° C. to about 200° C. so that the toner particles can readily be fused to a conventional paper receiving sheet to form a permanent image. Especially preferred polymers are those having a melting point within the range of from about 65 to about 120° C. Of course, where other types of receiving elements are used, for example, metal plates such as certain printing plates, polymers having a melting point and glass transition temperature higher than the values specified above can be used.

Among the various polymers that can be employed in the toner particles of the present invention are polycarbonates, resin-modified maleic alkyd polymers, polyamides, phenol-formaldehyde polymers, and polyester condensates. Polyester binders are a preferred embodiment of the invention. Particularly preferred are polyester condensates of fumaric acid with propoxylated bis-phenol-A.

Additionally, other polyesters having the aforementioned physical properties are also useful. Among such other useful polyesters are copolyesters prepared from terephthalic acid (including substituted terephthalic acid), a bis(hydroxyalkoxy)phenylalkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

Various kinds of well-known addenda (e.g., colorants, release agents, etc.) can also be incorporated into the toners of the invention. Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Color Index Volumes 1 and 2. Second Edition.

Included among the vast number of useful colorants are such materials as Hansa Yellow G (C.I. 11680), Nigrosine Spirit soluble (C.I. 50415), Chromogen Black ET00 (C.I. 45170), Solvent Black 3 (C.I. 26150), Fushsine N (C.I. 42510), C.I. Basic Blue 9 (C.I. 51015). Carbon black also provides a useful colorant. The amount of colorant added may vary over a wide range, for example, from about 1 to about 20 percent of the weight of the polymer. Particularly good results are obtained when the amount is from about 1 to about 10 percent.

To be utilized as toners in the electrostatographic developers of the invention, toners of this invention can be mixed with a carrier vehicle. The carrier vehicles, which can be used with the present toners to form the new developer compositions, can be selected from a variety of materials. Such materials include carrier core particles and core particles overcoated with a thin layer of film-forming resin.

The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. No. 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As noted above, the carrier particles can be overcoated with a thin layer of a film-forming resin for the purpose of establishing the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See, for example, U.S. Pat. Nos. 5,545,060; 4,478,925; 4,076,857; and 3,970,571. Such polymeric fluorohydrocarbon carrier coatings can serve a number of known purposes. One such purpose can be to aid the developer to meet the electrostatic force requirements mentioned above by shifting the carrier particles to a position in the triboelectric series different from that of the upcoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

A typical developer composition containing the above-described toner and a carrier vehicle generally comprises from about 1 to about 20 percent by weight of particulate toner particles and from about 80 to about 99 percent by weight carrier particles. Usually, the carrier particles are larger than the toner particles. Conventional carrier particles have a particle size on the order of from about 15 to about 1200 microns, preferably 20-200 microns.

Charge and Dust Measurements

A 4 gram developer sample at 10% toner concentration is prepared by mixing 3.6 g carrier and 0.4 g toner. The developer is mixed on a device that simulates the mixing that occurs in a printer developer station to charge the toner particles. The triboelectric charge of the toner is then measured after developer mixing using a MECCA device. The developer mixing can be achieved via magnetic agitation on a rotating multipole stirrer. The MECCA device comprises a set of parallel plate electrodes, spaced 1 cm apart by insulated plastic spacers. A weighed developer sample (typically 0.1 grams) is placed on the lower electrode, which is connected to a power supply typically set to 2000V, with the same polarity as that of the toner to be measured. The upper electrode is connected to a coulomb-meter. The developer sample is magnetically agitated by means of a 60 Hz AC coil positioned under the lower electrode. Developer is agitated in the presence of the electric field, resulting in the toner transferring to the upper plate, where the amount of charge transferred is measured with the coluombmeter. The toner collected is weighed, the measured charge is divided by the measured weight to calculate charge per mass in units of microcoulombs per gram, and the measured weight of toner is divided by the starting weight of developer to calculate the toner concentration.

The toner and developer compositions of this invention can be used in a variety of ways to develop electrostatic charge patterns or latent images. Such developable charge patterns can be prepared by a number of means and be carried for example, on a light sensitive photoconductive element or a non-lightsensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

The following preparations, measurements, tests, and examples are presented to further illustrate some preferred embodiments of the toners and developers of the invention and the charge agents employed therein, and to compare their properties and performance to those of toners, and developers outside the scope of the invention.

EXAMPLES

Toner samples containing inventive compounds were formulated by compounding 100 parts of a branched bis-Phenol A containing polyester and two parts of the inventive charge-control agent. The formulations were melt-blended on a two roll mill at 150° C. on a 4-inch (10.24 cm) roll mill, allowed to cool to room temperature and ground down to form inventive toner particles having an average particle size of approximately 10 micrometers as measured by a Coulter Counter. Inventive developers were prepared by combining 10 grams of the toner particles with 90.0 grams of carrier particles comprising strontium ferrite cores which had been coated at 230° C. with 0.75 parts of polyvinylidene fluoride (Kynar 301F manufactured by Pennwalt Corporation) and 0.50 parts of polymethylmethacrylate (Soken 1101 distributed by Esprix Chemicals).

The inventive compounds when melt compounded into toner result in toners with a stable negative charge as measured by averaging charge measurements taken over 10 charge, develop, and rebuild cycles. Table 1 reports data for toners made from polyester resin with the charge control agents listed. The toners were all ground to the same particle size distribution and surface treated with 0.4 wt % of silica flow aide. Developer samples were made using the toners all utilized the same carrier and were mixed to 10% TC. The developer samples were subjected to 10 cycles of charging by magnetic agitation on a rotating multipole stirrer, charge measurement using a MECCA device, and rebuilding with a fresh toner in the amount stripped out by the charge measurement.

TABLE 1

| Offline Charge | Bontron E-84 (Control) | Dimethyl Sulphone | Dibutyl Sulphone | Diphenyl Sulphone | Dibenzyl Sulphone |
|---|---|---|---|---|---|
| Min | 30.4 | 20.8 | 22.6 | 19.1 | 20.6 |
| Max | 43.7 | 25.4 | 29.7 | 24.0 | 27.4 |
| Range | 13.3 | 4.6 | 7.0 | 4.9 | 6.8 |
| Average | 33.3 | 22.6 | 27.5 | 22.3 | 24.4 |
| StDev | 3.7 | 1.3 | 2.1 | 1.4 | 2.2 |

The data in Table 1 demonstrate a number of improvements over the control material which used commercially available Orient Bontron E-84 as the charge control agent. First, charge stability throughout the test is much better for the inventive compounds as illustrated by the low standard deviations. Second, some difference in average charge is seen. This is advantageous from the standpoint of "dialability" of charge to thus enabling centering of the development process. All of the sulfones tested appear to show similar efficacy. All of the sulfones are colorless and thus suitable foe use in color toner applications. They are economically advantaged relative to currently available negative charge control agents.

The invention has been described with reference to a preferred embodiment; however, it will be appreciated that variations and modifications can be effected by a person of ordinary skill in the art without departing from the scope of the invention.

The invention claimed is:

1. An electrostatographic toner comprising:

a polymeric binder; and a sulfone charge control agent having the structure $X—SO_2—Y$ wherein X is an alkyl group and Y is an alkyl group.

2. The electrostatographic toner of claim 1 wherein the sulfone structure comprises $R—SO_2—R'$ wherein R and R' are alkyl groups containing from 1 to 24 carbon atoms and R may or may not be the same as R', R and R' may contain functional groups.

3. The electrostatographic toner of claim 2 wherein said functional groups comprise carboxylate, ester, or alcohol.

4. The electrostatographic toner of claim 2 wherein at least one of R and R' are saturated cyclic moieties containing at least one member from one of the group consisting of sulfur, oxygen, phosphorus, and nitrogen.

5. The electrostatographic toner of claim 2 wherein said sulfone comprises dimethyl sulfone.

6. The electrostatographic toner of claim 1 wherein said polymer binder is selected from the group consisting of polycarbonates, resin-modified maleic alkyd polymers, polyamides, phenol-formaldehyde polymers, and polyester condensates.

7. The electrostatographic toner of claim 1 further comprising: colorant materials.

8. The electrostatograpbic toner of claim 1 further comprising: release agents.

9. An electrostatographic developer comprising:

a polymeric binder;

a sulfone charge control agent having the structure $X—SO_2—Y$ wherein X is an alkyl group and Y is an alkyl group; and carrier particles.

10. The electrostatographic developer of claim 9 wherein said polymer binder is selected from the group consisting of polycarbonates, resin-modified maleic alkyd polymers, polyamides, phenol-formaldehyde polymers, and polyester condensates.

11. The electrostatographic developer of claim 9 wherein the carrier particles comprise from 1 to about 20 percent by weight of the developer.

12. The electrostatographic developer of claim 9 wherein the carrier particles have a particle size of from 20 to 1200 microns.

13. The electrostatographic developer of claim 9 wherein said polymer binder comprises polyester.

14. The electrostatographic developer of claim 9 wherein the sulfone comprises dimethylsulfone.

15. The electrostatographic toner of claim 1 wherein said polymer binder comprises polyester.

16. The electrostatographic toner of claim 1 wherein the sulfone comprises dimethylsulfone.

* * * * *